US005164553A

United States Patent [19]

Kitahara et al.

[11] Patent Number: 5,164,553

[45] Date of Patent: Nov. 17, 1992

[54] KEY INPUT DEVICE

[75] Inventors: Jun Kitahara, Yokohama; Yoshiaki Kitazume, Sayama; Hiromichi Itoh, Yokohama; Takashi Tsunehiro, Ebina, all of Japan

[73] Assignee: Hitachi, Ltd., Tokyo, Japan

[21] Appl. No.: 609,658

[22] Filed: Nov. 6, 1990

[30] Foreign Application Priority Data

Nov. 8, 1989 [JP] Japan ..... 1-290423

[51] Int. Cl.[5] ..... H01H 13/70

[52] U.S. Cl. ..... 200/5 A; 200/302.2

[58] Field of Search ..... 200/5 A, 292, 302.2, 200/520, 530-532, 341-345

[56] References Cited

U.S. PATENT DOCUMENTS 3,996,429 12/1976 Chu et al. ..... 200/5 A
4,074,088 2/1978 Keough et al. ..... 200/5 A
4,203,013 5/1980 Serras-Paulet ..... 200/5 A

FOREIGN PATENT DOCUMENTS 55-143720 11/1980 Japan .
1-276520 11/1989 Japan .

*Primary Examiner*—J. R. Scott
*Attorney, Agent, or Firm*—Antonelli, Terry, Stout & Kraus

[57] ABSTRACT

A key input device including a plurality of keytops, with an elastic member being disposed between each keytop and a printed circuit board so as to be supported at a lower end portion thereof by an upper surface of the printed circuit board and pushed upwardly to cause the keytop to be biased upwardly. An engaging portion, provided on a main body of each keytop, prevents the keytop from coming out of a hole accommodating the respective keytops. The depressing stroke of the respective keytops can be defined by an upper casing an the printed circuit board regardless of the state of elastic deformation of the elastic member. An insulating substrate may be provided on the printed circuit board, with printed electrodes being formed on an upper surface of the insulating substrate in an opposed relationship to the keytops in such a manner that, when one of the keytops is depressed, the printed electrodes are brought into contact with the contact electrodes corresponding to the depressed keytop. Printed wiring conductors or strips can be formed on the upper surface of the printed circuit board on which the printed electrodes for the keytop switches are formed. The circuit elements or electronic components, connected through the printed wiring conductors or strips, can be mounted on the lower surface side of the printed circuit board resulting in a common printed circuit board for holding the keytop switches and the mounting of the electronic components.

9 Claims, 7 Drawing Sheets

KEY INPUT DEVICE

FIELD OF THE INVENTION

The present invention relates to a key input device and electronic equipment incorporating the same and, more particularly, to a key input device and electronic equipment which are capable of assuring a reduction in size and weight.

BACKGROUND OF THE INVENTION

FIGS. 7 and 8 depict a conventional key input device 101 for an electronic equipment 100, wherein an upper casing 102 cooperates with a lower casing 103 to form a receiving chamber 104. The receiving chamber 104 is divided into three small chambers 107, 108 and 109 by upper and lower printed circuit boards 105 and 106 arranged in the receiving chamber 104 and fixed to and supported by the upper and lower casings 102 and 103, respectively. A plurality of keytop switches 114, each having a keytop 110, a key case 111 and electrode pins 112 and 113, are disposed on the printed circuit board 105. The small chamber 107 is nearly occupied by the key cases 111. The pins 112 and 113 are inserted into through-holes (not shown) in the printed circuit board 105 and fixed thereto by soldering or the like. The pins 112 and 113 are electrically connected through a contact electrode portion (not shown) in the key case 111 when the keytop 110 is depressed in the direction of an arrow A (FIG. 8). This kind of keyswitch (although having four pins) is disclosed in detail in Japanese Patent Unexamined Publication No. 55-143720, for example. As shown in FIG. 8, a spring 115 serves to bias the keytop 110 in the direction of an arrow B, and printed conductors or wiring strips 116, formed on a lower surface 117 of the printed circuit board 105, serve to connect the electrode pins 112 and 113 of the keyswitches 114 to an external circuit, power source or the like. On the other hand, circuit elements or electronic parts or components 118 such as, for example, integrated circuits are mounted on the printed circuit board 106. Pins 119 of the electronic components 118 are inserted into through-holes (not shown) in the printed circuit board 106 and fixed thereto by soldering or the like. Printed conductors or wiring strips 120, formed on a lower surface 121 of the printed circuit board 106, serve to connect the electrode pins 119 of a plurality of electronic components 118 to each other or to an external circuit, power source or the like. Connectors 122 and connecting cables 123 serve to connect the two printed circuit boards 105 and 106 to each other with the circuit boards 105, 106 having a space therebetween.

In this kind of conventional key input device 101, however, the key cases 111 occupying the small chamber 107 nearly cover an upper surface 124 (FIG. 7) of the printed circuit board 105 so that it is impossible, in practice to form printed conductors or wiring strips on the upper surface 124. Furthermore, the electrode pins 112 and 113 extending downwardly from the key cases 111 project out from the lower surface 117 of the printed circuit board 105 and the printed wiring conductors or strips 116 are formed on the lower surface 117 for establishing electrical connection to the electrode pins 112 and 113 through the solder or the like. Therefore, it is difficult, in practice, to mount the electronic components 118 with associated pins 119 on a lower surface 117 of the printed circuit board 105. Consequently, since it is necessary to provide another printed circuit board 106 in order to mount the electronic components 118, there is a limit in size- and weight-reduction of the key input device 101. In other words, it is difficult to increase the mounting capacity of the electronic components 118 and, hence, to enhance the function of the drive within a limited occupation space. In addition, the key input device 101 requires at least two sets of connectors 122 for the purpose of connecting the printed circuit board 105 on which the keyswitches 114 are mounted to the printed circuit board 106 on which the electronic components 118 associated with the keyswitches 114 are mounted.

There has also been proposed a switch structure in Japanese Patent Unexamined Publication No. 1-276520, which aims at reduction of the number of components and simplification of the structure. A switch assembly 131 of this proposal comprises, as shown in FIG. 9, a rigid dielectric substrate 135 formed on an upper surface 134 thereof with printed conductor or wiring strips 132 and 133 constituting an input conduction path and an output conduction path, respectively. A spring band or strip 139 is fixed to the output conduction path 133 at stationary contacts 137 at the lower ends of four elastic leg portions 136 thereof and has two movable contacts 138 at intermediate portions thereof, a switch head 142 having a projecting portion 141, is fitted in a hole 140 of the spring band 139 and serves to bring the movable contacts 138 of the spring band 139 into contact with the input conduction path 132 when depressed in the direction of an arrow C. An input lead piece 147 and an output lead piece 148 has ends 143 and 144 thereof respectively connected with the input conduction path 132 and the output conduction path 133 and the opposite ends 145 and 145 extending downwardly. A stop 149 restricts the head 142 from being depressed in the direction C beyond a fixed depth.

Japanese Patent Unexamined Publication No. 1-276520 does not disclose the manner of mounting the switch assembly 131, however, it is considered from the arrangement and shape of the input and output lead pieces 147 and 148 that the switch assembly 131 is also mounted by inserting the input and output lead pieces 147 and 148 into through-holes in a printed circuit board. Accordingly, even if the switch assembly 131 is applied to the key input device, it is necessary to provide another printed circuit board for mounting electronic components as with the key input device of FIGS. 7 and 8.

OBJECT AND SUMMARY OF THE INVENTION

The above-described points, and an object of the invention is to provide a key input device which is capable of assuring reduction in size and weight or increasing the mounting capacity to enhance the function.

To this end, according to the present invention, a key input device comprises an upper casing provided with an upper flat plate portion having a large number of penetrating holes formed therein, a lower casing cooperating with the upper casing to form a receiving chamber, and a printed circuit board disposed in the receiving chamber and fixed to at least one of the upper and lower casings. A plurality of keytops are disposed between the upper casing and the printed circuit board within the receiving chamber with each of the keytops having a keytop main body movable up and down with respect to the upper flat plate portion and respectively extending through the penetrating holes from the receiving chamber so as to be projected out upwardly from the upper flat plate portion of the upper casing. An engaging portion projects sidewards from the keytop main body so as to be engaged with a peripheral edge portion of the corresponding penetrating hole at a lower surface of the upper flat plate portion, with a plurality of contact electrodes each being connected to a lower portion of the respective keytops so as to be movable in accordance with vertical movement of the corresponding keytop. A plurality of elastic members are respectively disposed between the keytops and the printed circuit board in order to bias upwardly the corresponding keytop, with a lower end thereof being supported by an upper surface of the printed circuit board and an upper end thereof serving to push the keytop upwardly.

In the key input device having the above construction, each of the keytops is provided with the engaging portion projecting sidewards from the keytop main body so as to be engaged with the peripheral edge portion of the corresponding penetrating hole at the lower surface of the upper flat plate portion of the upper casing, and the elastic member is disposed between each keytop and the printed circuit board so that it is supported at its lower end portion by the upper surface of the printed circuit board and the elastic member pushes the keytop upwardly at its upper end portion to cause the keytop to be biased upwardly. Therefore, since the keytop is prevented from coming out of the penetrating hole in the upper casing by the engaging portion thereof, the keytop switches need not be fixed to through-holes in the printed circuit board with pins, resulting in the elimination of the printed circuit board to which the keytop switches of the key input device are to be fixed. Consequently, in a case of occupying the same space with use of the printed circuit board, the mounting density of the electronic components in this space can be increased. As a result, the function of the key input device can be enhanced in the case where the same space can be provided or utilized. Moreover, the depressing stroke of the keytop can be defined by the upper casing and the printed circuit board regardless of the state of elastic deformation of the elastic member.

The "upper" side of the key input device means, herein, the keytop side of the assumption that the key input device is used in the normal condition. Therefore, the present invention includes the key input device which is used with the keytops thereof directed downwardly.

In a key input device according to a preferred embodiment of the present invention, the printed circuit board comprises an insulating or dielectric substrate or board formed therein with a plurality of through-holes into which pins of circuit elements are to be inserted, and printed electrodes formed on an upper surface of the insulating substrate in opposite relation to the keytops in such a manner that, when one of the keytops is depressed, the printed electrodes are brought into contact with the contact electrodes corresponding to the depressed keytop. Therefore, printed wiring conductors or strips can be formed on the upper surface of the printed circuit board on which the printed electrodes for the keytop switches are formed and, at the same time, the circuit elements or electronic components which are connected through the printed wiring conductors or strips formed on the upper surface of the printed circuit board can be mounted on the lower surface of the printed circuit board, resulting in a common printed circuit board being used both as the printed circuit board for holding the keytop switches and the printed circuit board for mounting the electronic components. Namely, the number of printed circuit boards on which the electronic components associated with the keytop switches of the key input device are to be mounted can be reduced by one and, hence, related connectors can be eliminated. In other words, in a case that the same number of (two, for example) printed circuit boards are used to occupy the same space, the mounting density of the electronic components in this space can be increased. As a result, it is possible to enhance the function of the key input device.

More specifically, in the key input device according to a preferred embodiment of the invention, the printed circuit board is formed on the upper surface of the insulating substrate or dielectric board thereof with the printed wiring conductors or strips by means of which the circuit elements or the electronic components are electrically connected with their pins inserted into the through-holes. In this case, it is preferred to dispose the circuit elements on the lower surface side of the insulating substrate. Further, it is preferred for increasing the density of the printed wiring conductors or strips, that insulating or dielectric films serving to protect the printed wiring conductors or strips are interposed between the lower end portions of the elastic members and the printed wiring conductors or strips in such a manner so as to permit the printed wiring conductors or strips to be formed even under the lower end portions of the elastic members.

In the key input device according to a preferred embodiment of the invention, each keytop has a concave portion formed in the lower end surface thereof so that the upper end of the elastic member is fitted in the concave portion of the keytop.

In the key input device according to a preferred embodiment of the invention, the elastic member and the contact electrode are formed by a unitary bent sheet metal member.

In the key input device according to a preferred embodiment of the invention, in order to prevent foreign matter from entering into the receiving chamber through a gap between the peripheral wall of each penetrating hole in the upper case and each of the keytop main bodies, a foreign matter entry preventing means is further provided in this gap.

Another object of the present invention is to provide electronic equipment which is capable of ensuring reduction in size and weight or increasing the mounting capacity to enhance the function.

To this end, according to the present invention, the electronic equipment comprises the above described key input device and an electronic equipment main body which receives input signals from the key input device.

This electronic equipment may include any electronic equipment such as an information input and processing device such as a computer, a measuring instrument, a telephone, and a electronic calculator, so far as it receives input signals from the key input device.

The foregoing and other objects, features as well as advantages of the invention will be made clearer by the description of preferred embodiments referring to drawings hereinafter.

DETAILED DESCRIPTION OF PREFERRED EMBODIMENT

Figure 1:
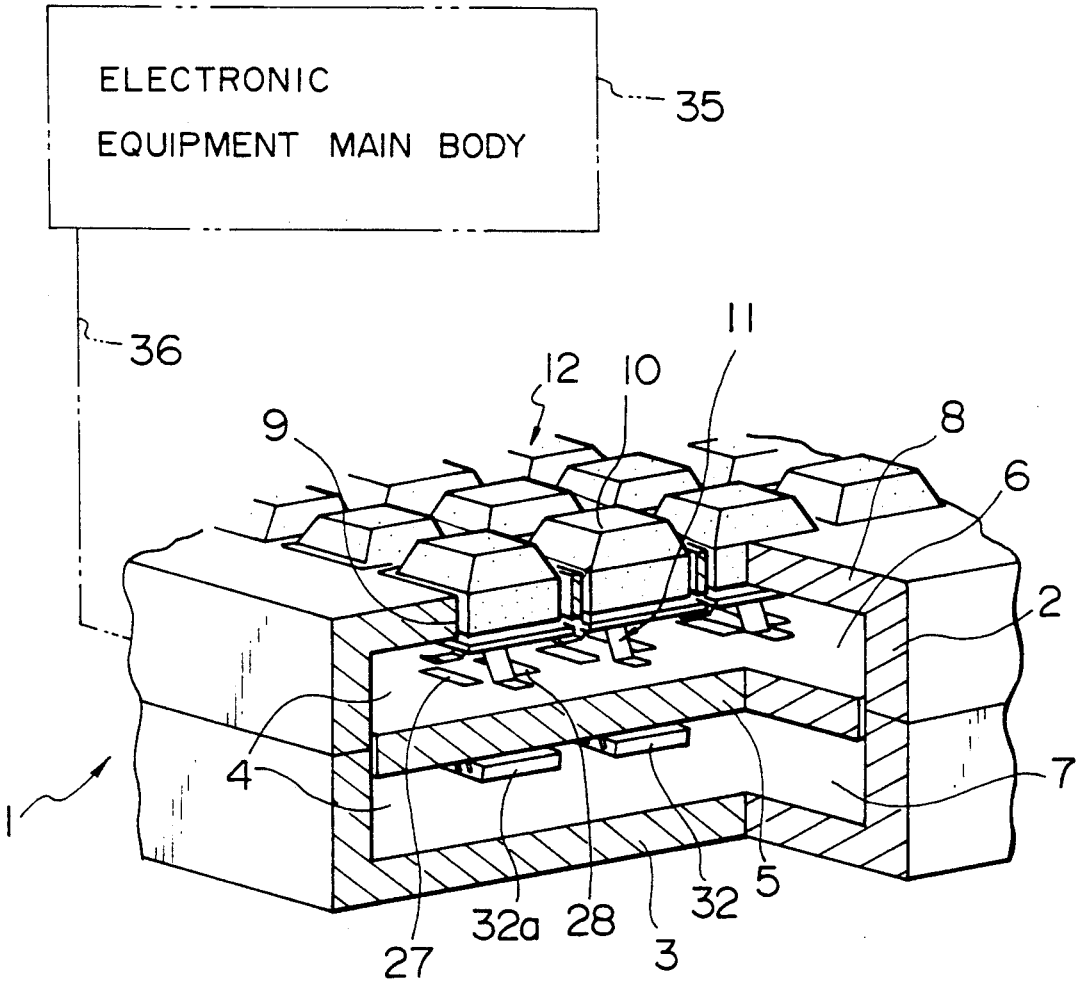
FIG. 1 is a partially broken perspective view of a part of a key input device and electronic equipment having the same according to a preferred embodiment of the present invention.
Figure 2:
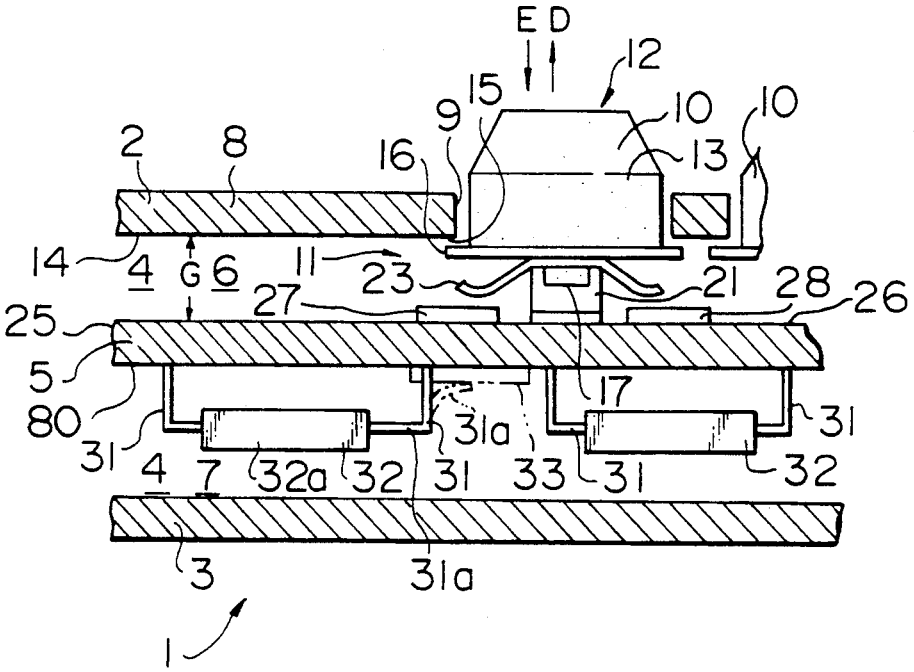
FIG. 2 is a vertical sectional view of a part of the device shown in FIG. 1.
Figure 3:
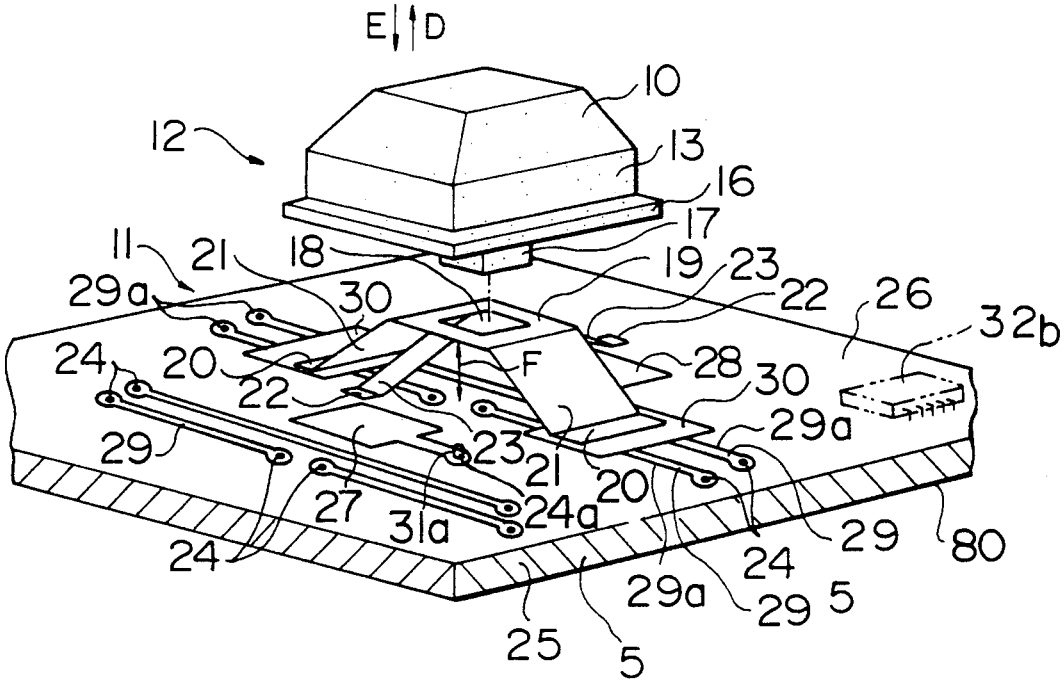
FIG. 3 is a partly disassembled (developed) perspective view showing, on an enlarged scale, one of keytop switches of the key input device of FIG. 1.

Referring now to the drawings wherein like reference numerals are used throughout the various views to designate like parts and, more particularly, to FIGS. 1–3, according to these figures, a key input device 1, in accordance with the present invention, includes an upper casing 2 cooperable with a lower casing 3 to form a receiving chamber 4, with the receiving chamber 4 being divided into two small chambers 6 and 7 by a printed circuit board 5 disposed in the receiving chamber 4 and fixed to the upper or lower casing 2 or 3. A large number of penetrating holes 9 are formed in an upper flat plate portion 8 of the upper casing 2. A large number of keytop switches 12 each comprising a keytop 10 of substantially the same shape (square, for example) as that of the penetrating hole 9 on the plane and a key-side switch electrode portion 11 are disposed between the upper casing 2 and the printed circuit board 5 within the small chamber 6 of the receiving chamber 4. Each keytop 10 has a keytop main body 13 extending through the corresponding penetrating hole 9 from the receiving chamber 4 so as to project upwardly from the upper flat plate portion 8 of the upper casing 2. The keytop main body 13 is movable up and down in the directions of arrows D and E with respect to the upper flat plate portion 8 and an engaging portion 16, projecting sidewards from the keytop main body 13, is engageable with a peripheral edge portion 15 of the corresponding penetrating hole 9 at a lower surface 14 of the upper flat plate portion 8. A projection 17, projecting downwards from the lower end of the keytop main body 13, serves as fitting and stop member. It is noted that the engaging portion 16 may have any shape so far as it can be engaged with the peripheral edge portion 15 of the corresponding penetrating hole 9 on the lower surface 14 of the upper flat plate portion 8. Further, it is preferred to provide the engaging portion 16 at the lower end of the keytop main body 13 in order to minimize the size of the small chamber 6; however, the engaging portion 16 may be provided, in some cases, at a position located above the lower end of the keytop main body 13 to some extent so far as the upper end of the keytop main body 13 can project out upwardly from the upper casing 2 by a sufficient distance.

The key-side switch electrode portion 11 is constituted by a bent elastic sheet metal member having a rectangular or oblong top surface portion 19 formed therein with a rectangular hole 18 into which the projection 17 of the keytop 10 is to be fitted, two elastic or resilient leg portions 21 extending obliquely downwards from a pair of opposite edges of the top surface portion 19 and each having a bent foot portion 20 at the lower end thereof, and two elastic or resilient leg portions 23 extending obliquely downwards from another pair of opposite edges of the top surface portion 19 and each having a bent foot portion 22 at the lower end thereof, with the length of the elastic leg portions 23 being shorter than that of the leg portions 21. It is noted that the hole 18 and the projection 17 of the keytop 10 may have any shape and cross-sectional shape as long as the projection 17 of the keytop 10 is fitted in the hole 18 exactly so as to be prevented from rotating with respect to the switch electrode portion 11. The foot portions 20 of the long elastic leg portions 21 are put on the printed circuit board 5, and the foot portions 22 of the short elastic leg portions 23 are normally spaced from the printed circuit board 5 due to elastic forces of leaf springs 21 and 21 acting to bias them in the direction of the arrow D. It is noted that the sum of a vertical height F (FIG. 3) of the leg portion 21 and a thickness of the engaging portion 16 of the keytop 10 is greater than a distance G (FIG. 2) between the upper flat plate portion 8 of the upper casing 2 and the printed circuit board 5 when no external force is applied. Accordingly, when the upper and lower casings 2 and 3 are assembled and fixed to each other as shown in FIGS. 1 and 2, the long leg portions 21 of the key-side switch electrode portion 11, which is the elastic bent sheet metal member, are deformed elastically to push the projected engaging portion 16 of the keytop 10 upwardly in the direction of the arrow D, toward the edge portion 15 of the penetrating hole 9 at the lower surface 14 of the upper casing 2.

The printed circuit board 5 has an insulating substrate or a dielectric board 25 having a plurality of through-holes 24 formed therein. Two printed electrodes 27 and 28 associated with each of the keytop switches 12 and a large number of printed wiring strips or conductors 29 are formed on an upper surface 26 of the insulating substrate 25. An insulating and wear-resistant protective film 30 made, for example, of polytetrafluoroethylene is interposed between each long elastic leg portion 21 and a printed wiring conductor or strip **29*a* provided thereunder and fixed to the upper surface 26 of the printed circuit board 5 so as to mechanically protect the printed wiring conductor or strip 29*a* and electrically insulate or isolate the long leg portion 21 and the printed wiring conductor or strip 29*a* from each other. The provision of the protective film 30 makes it possible to form the printed wiring conductor or strip 29 even under the elastic leg portion 21 so that the printed wiring conductors or strips 29 can be easily formed on the upper surface of the substrate 25 at high density as described. As the keytop 10 of the keytop switch 12, supported by the printed circuit board 5 through the insulating protective film 30, is depressed in the direction of the arrow E, the long elastic leg portions 21, serving as the leaf springs, are deformed elastically to cause the foot portions 22 of the short leg portions 23 constituting the contact electrodes to come in contact with the printed electrodes 27 and 28, thereby causing the keytop switch 12 to operate. The keytop 10 is depressed in the direction of the arrow E until the lower end of the projection 17 abuts against the upper surface of the printed circuit board 5. The lengths of the two leg portions 23, 23 may differ from each other so that one of the two leg portions 23, 23 comes in contact with the corresponding printed electrode 27 or 28 earlier than the other. As the keytop 10 is released from being depressed in the direction of the arrow E, the keytop 10 is pushed back in the direction of the arrow D due to the elastic forces of the elastic leg portions 21 of the key-side electrode portion 11 until the projected engaging portion 16 abuts against the lower surface 14 of the upper flat plate portion 8. Contact and electric connection of the contact electrodes 23 with the corresponding printed electrodes 27 and 28 is released or opened before the engaging portion 16 of the keytop 10 abuts against the lower surface 14 of the upper flat plate portion 8. So far as the protective film 30 are pressed to be held by the two elastic leg portions 21, it is not necessary to fix the protective film 30 to the upper surface 26 of the printed circuit board 5 by separate fixing means. The elastic leg portion 21 itself may, for example, constitute a stationary contact fixed to the printed electrode 29 formed on the upper surface of the printed circuit board 5, where no protective film 30** is provided.

Electronic components 32 are mounted on a back or lower surface 80 of the printed circuit board 5 by inserting pins 31 thereof into through-holes 24 formed in the substrate 25. In the illustrated embodiment, a pin 31*a* among the pins 31 on one side of an IC 32*a*, for example, is inserted into and soldered to a through-hole 24*a* electrically connected to the printed electrode 27. Further, in the case that electrical connection between the opposite surfaces 26 and 80 of the substrate 25 is already established through the through holes 24*a*, for example, if a printed wiring strip 33 can be formed on the lower surface 80 of the insulating substrate 25 sufficiently firmly, all or part of lead wires or pins 31 such as a lead wire or pin 31*a* may be soldered to the printed wiring strip 33 formed on the lower surface 80 of the printed circuit board 5 as indicated by imaginary lines in FIG. 2. In this case, most of the electronic parts or components 32 constituting the electronic equipment main body may be mounted only on the lower surface 80 of the printed circuit board 5.

The electronic equipment main body 35 (FIG. 1) such as, for example, a computer mainframe, is connected to the key input device 1 through a cable 36 so as to receive and process input signals from the key input device 1.

In the key input device 1 having the above construction, since the keytop 10 is prevented from coming out of the penetrating hole 9 in the upper casing 2 by the engaging portion 16 thereof, it is not necessary to fix the keytop switch 12 to the through-holes 24 in the printed circuit board 5 with pins; therefore, it is possible to dispense with the provision of the printed circuit board to which the key top switches 12 of the key input device 1 are fixed. In addition, the depressing stroke of the keytop 10 can be defined by the upper casing 2 and the printed circuit board 5 regardless of the state of elastic deformation of the elastic member or the leaf spring 19. In the key input device 1, the depressing stroke of the keytop 10 is further defined by the projection 17 as well.

Moreover, in the key input device 1, the printed circuit board 5 disposed below the keytops 10 comprises the insulating substrate 25 formed therein with a plurality of through-holes 24 into which the pins 31 of the circuit elements 32 are inserted, and the printed electrodes 27, 28 are formed on the upper surface 26 of the insulating substrate 25 in opposite relation to the keytops 10 in such a manner that, when one of the keytops 10 is depressed in the direction from the arrow E, the printed electrodes 27, 28 associated therewith are brought into contact with the contact electrodes 23 corresponding to the depressed keytop 10. Therefore, the printed wiring conductors or strips 29 can be formed on the upper surface 26 of the printed circuit board 5 and, at the same time, the circuit elements or the electronic components 32 which are connected through the printed wiring conductors or strips 29 formed on the upper surface 26 can be mounted on the lower surface 80 of the printed circuit board 5, resulting in that the number of printed circuit boards on which the electronic components 32 associated with the keytop switches 12 of the key input device 1 are to be mounted can be surely reduced by one and, hence, related connectors can be dispensed with. In other words, in a case that the same number of (two, for example) printed circuit boards 5 are used to occupy the same space, the mounting density of the electronic components 32 in this space can be increased. As a result, it is possible to enhance the function of the key input device 1 and hence the function of the electronic equipment comprising the key input device 1 and the electronic equipment main body 35.

It is noted that, if there is a surplus space on the upper surface 26 of the printed circuit board 5, an electronic component 32*b* may be arranged on the upper surface 26 as indicated by imaginary lines in FIG. 3 and printed wiring strips corresponding to this component may be formed on the upper or lower surface 26 or 80 of the printed circuit board 5 depending on the way of connecting the pins thereof with them.

Figure 4:
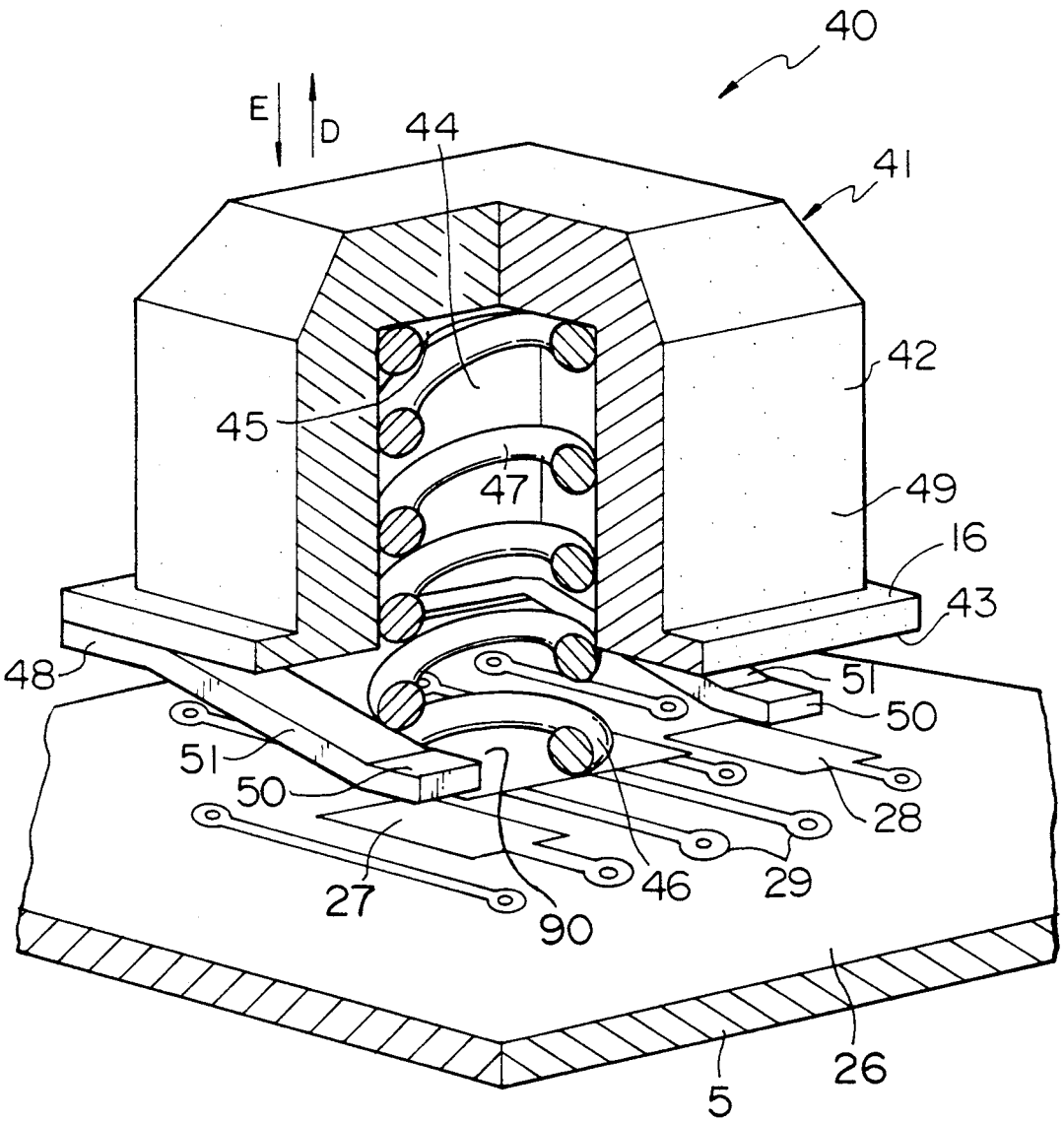
FIG. 4 is a perspective view showing, similarly to FIG. 3, on an enlarged scale, one of keytop switches of a key input device according to a modification of the embodiment of the invention.

FIG. 4 illustrates one of keytop switches 41 and its peripheral similar to FIG. 3 of a key input device 40 according to a modification of the embodiment of the invention. The keytop switch 41 has, in place of the key-side switch electrode portion 11 of the keytop switch 12 shown in FIGS. 1 to 3, a coiled spring 47 which is fitted at a portion thereof, near its one end 45, into a concave portion 44 formed in a bottom portion 43 of the keytop main body 42 and pressed at its other end 46 against the upper surface 26 of the printed circuit board 5 through an insulating protective film 90, and substantially U-shaped contact electrodes 51, 51 fixed at a portion thereof corresponding to a base portion 48 to the lower surface of the engaging portion 16 of a keytop 49 and having two end portions 50, 50 opposed to the printed electrodes 27, 28 formed on the upper surface 26 of the printed circuit board 5.

In the keytop switch 41, the coiled spring 47 functions in the same manner as the long elastic leg portion 21 of the keytop switch 12 and the contact electrode 51 functions in the same manner as the short leg portion 23. Namely, the coiled spring 47, serving to normally bias the keytop 49 in the direction of the arrow D in the same assembled state as in FIGS. 1 and 2, has a length that normally positions the lower end foot portions 50, serving as the contacts of the contact electrodes 51, at a spacing from the printed electrodes 27, 28 due to an expansion force attributable to its elasticity and that makes the engaging portion 16 of the keytop 49 abut against the lower surface 14 of the upper flat plate portion 8 of the upper casing 2. Further, the protective film 90 functions in the same manner as the protective film 30. In the embodiment of FIG. 4, since the protective film 90 receives the force from the spring 47 in the direction perpendicular to the board 5 unlike the embodiment shown in FIGS. 1 to 3, there is no possibility that the protective film 90 slides on the surface 26 of the printed circuit board 5.

Any other spring that the illustrated leaf spring and coiled spring can be used as the elastic member which serves to press the engaging portion 16 of the keytop 10, 49 against the upper flat plate portion 8 of the upper casing 2. Further, the contact electrode 23, 51 can have any shape as long as the shape can fulfil the function thereof. For example, spring and contact electrode which are used in the keytop switch portion of a small electronic calculator may be used as the elastic member and contact electrode of the keytop switch 12, 41.

Figure 5:
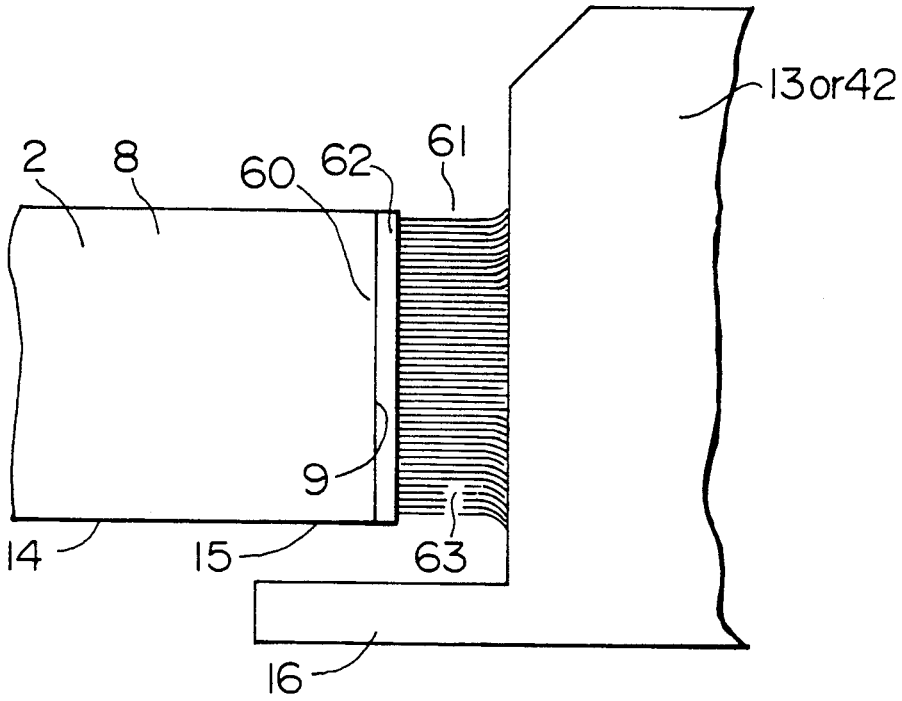
FIG. 5 is a schematic view of a part of a key input device according to another modification of the embodiment of the invention.
Figure 6:
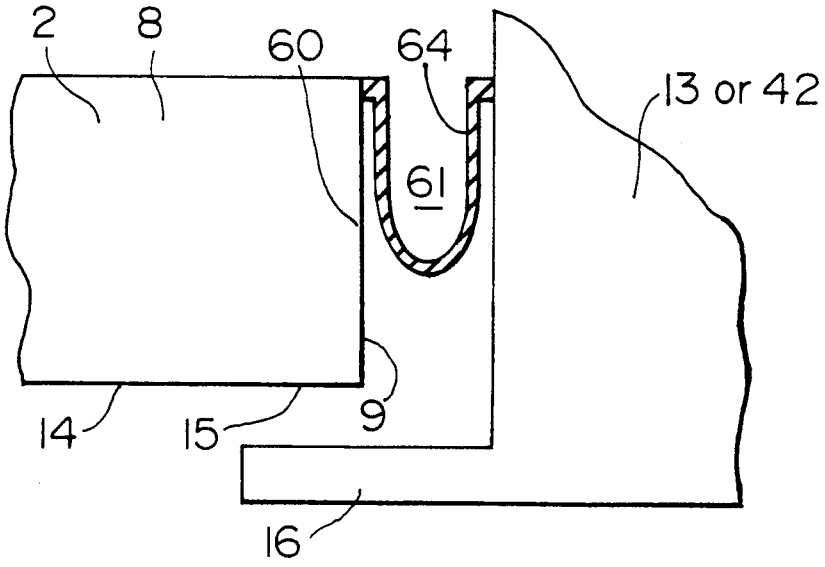
FIG. 6 is a schematic view of a part of a key input device according to still another modification of the embodiment of the invention.
Figure 7:
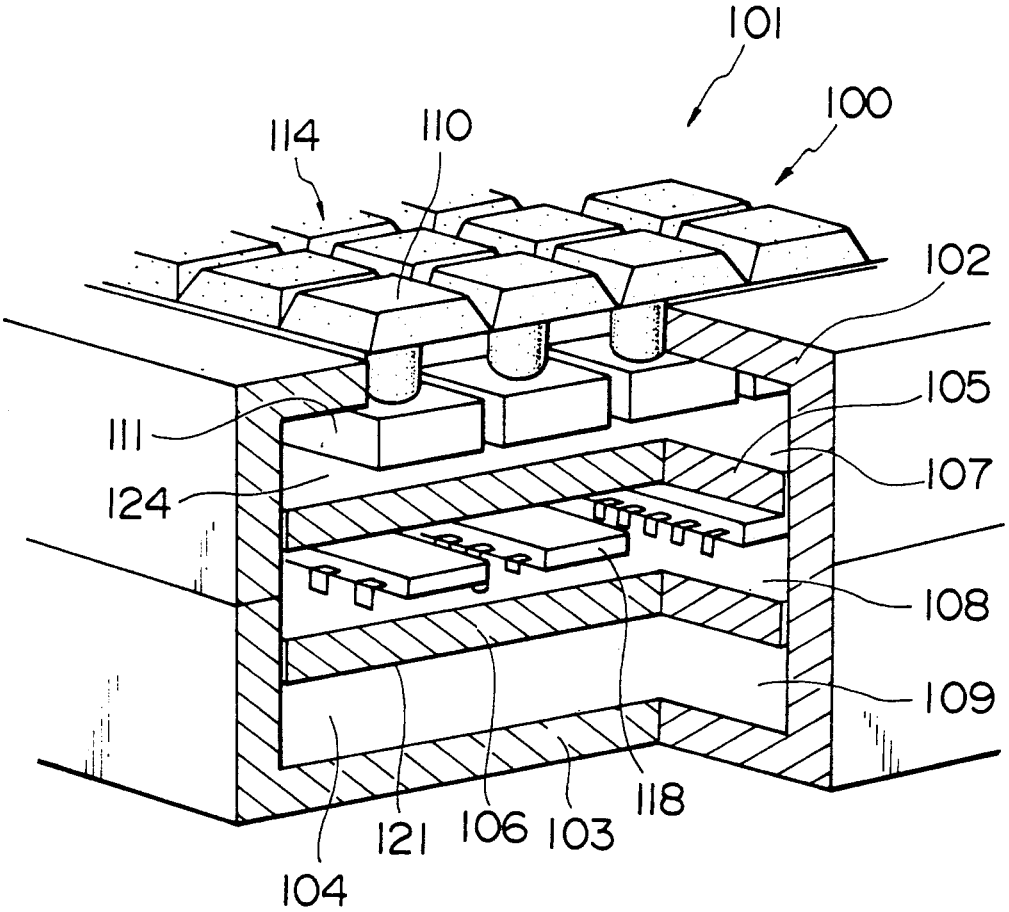
FIG. 7 PRIOR ART
FIG. 7 is a partially broken perspective view of a part of a conventional key input device.
Figure 8:
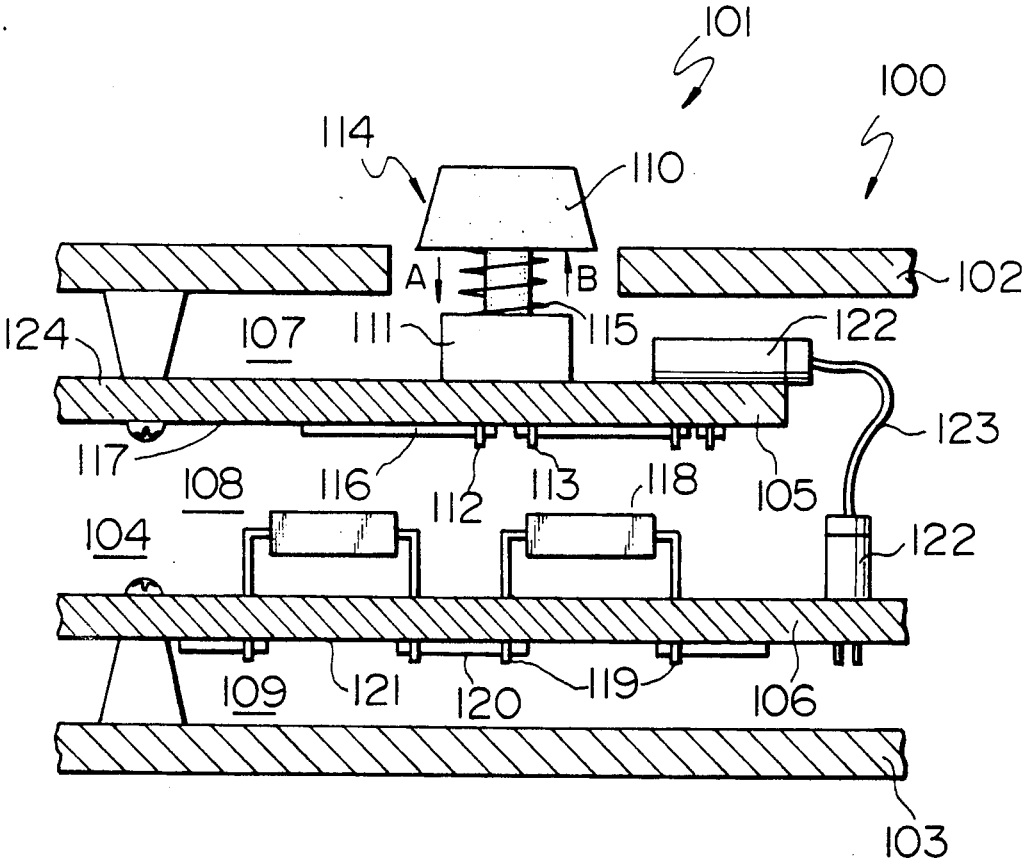
FIG. 8 PRIOR ART
FIG. 8 is a sectional view of FIG. 7.
Figure 9:
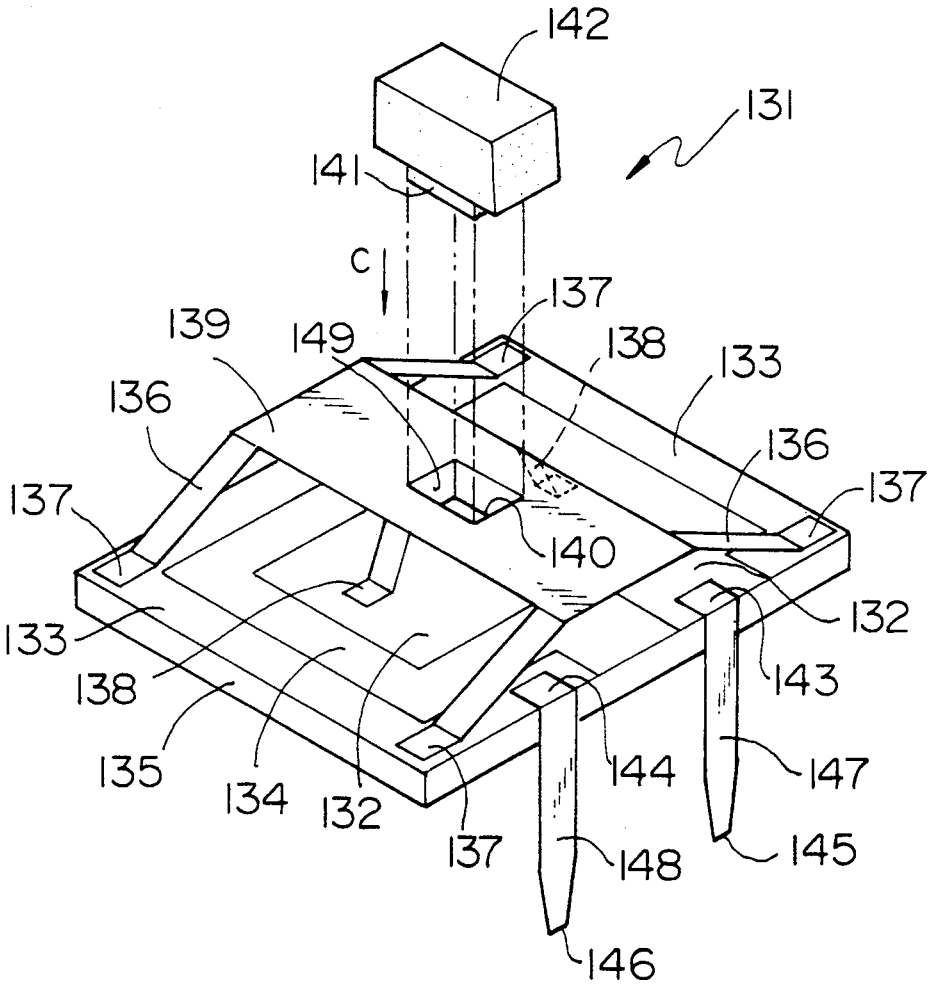
FIG. 9 PRIOR ART
FIG. 9 is a perspective view of a conventional switch structure.

In the key input devices 1 and 40, if there is a possibility that foreign matter such as, for example, dust or the like will enter into the receiving chamber 4 through a gap 61 between each keytop main body 13 or 42 and a peripheral wall 60 of each penetrating hole 9 in the flat plate portion 8 of the upper casing 2, as shown in FIG. 5, a flocked sheet 62 may be adhered to the peripheral wall 60 to prevent the dust or the like from entering into the receiving chamber 4 by hairs of flocks 63 of the flocked sheet 62. Further, as shown in FIG. 6, in place of the flocked sheet 62, a film 64 made of a flexible and elastic material such as, for example, rubber, may be spread between each keytop main body 13 or 42 and the peripheral wall 60 of each penetrating hole 9 in the flat plate portion 8 of the upper casing 2 so as to prevent the dust or the like from entering through the gap 61.

Description has been made hereinabove on the embodiments in which a single printed circuit board is used, and however, a plurality of printed circuit boards may be arranged in parallel relation or stacked with a suitable distance left between adjacent boards.

What is claimed is:

1. A key input device comprising:

an upper casing provided with an upper flat plate portion having a large number of penetrating holes formed therein;

a lower casing cooperating with said upper casing to form a receiving chamber;

a printed circuit board disposed in said receiving chamber and fixed to at least one of said upper and lower casings, said printed circuit board having a flat upper surface with a plurality of pairs of printed contact electrodes thereon;

a plurality of keytops disposed between said upper casing and said printed circuit board within said receiving chamber, each of said keytops having a keytop main body movable up and down with respect to said upper flat plate portion of said upper casing, and an engaging portion projecting sidewards from said keytop main body so as to be engageable with a peripheral edge portion of the penetrating hole through which the keytop extends, said engaging portion being engageable with the peripheral edge portion at a lower surface of said upper flat plate portion;

a plurality of contact electrodes each fixed to a lower portion of a corresponding one of said keytops so as to be movable in accordance with the vertical movement of said corresponding keytops; and a plurality of elastic members each disposed between a corresponding one of said keytops and said printed circuit board for biasing the respective keytops upwardly, a lower end of said elastic member being supported by the flat upper surface of said printed circuit board, and an upper end of said elastic member pushing said keytop upwardly, thereby enabling said contact electrode fixed to said keytop to be spaced at a position upwardly from said printed contact electrodes.

2. A key input device according to claim 1, wherein said printed circuit board comprises a dielectric substrate having the flat upper surface thereon and a plurality of through-holes therein into which pins of circuit elements are insertable.

3. A key input device according to claim 2, wherein said printed circuit board is formed on the flat upper surface of said dielectric substrate with printed wiring conductors by which said circuit elements are electrically connected by pins inserted into said through-holes.

4. A key input device according to claim 3, wherein said circuit elements are mounted on a lower surface of said dielectric substrate.

5. A key input device according to claim 3, wherein insulating films for protecting said printed wiring conductors are interposed between the lower ends of said elastic members and said printed wiring conductors.

6. A key input device according to claim 3, wherein each of said keytops has a concave portion formed in a lower end surface thereof so that the upper end of each of said elastic members is fitted into said concave portion of said keytop.

7. A key input device according to claim 3, wherein the upper end of said elastic member is integral with an upper part of said contact electrode to form a unitary bent sheet metal member.

8. A key input device according to claim 1, wherein a peripheral wall of each penetrating hole in said upper casing and a corresponding one of said keytop main bodies define a gap therebetween, said key input device further comprising a foreign matter entry preventing means provided in said gap between the peripheral wall of each penetrating hole and the corresponding one of said keytop main bodies to prevent foreign matter from entering said receiving chamber through said gap.

9. A key input device according to claim 1, wherein printed wiring conductors are formed on a lower surface of the printed circuit board, and at least one circuit element is mounted on the lower surface of the printed circuit board with pins thereof connected to the printed wiring conductors.

* * * * *